US005403499A

United States Patent [19]

Kiefer et al.

[11] Patent Number: 5,403,499

[45] Date of Patent: Apr. 4, 1995

[54] CONCENTRATED FABRIC CONDITIONING COMPOSITIONS

[75] Inventors: Jesse J. Kiefer, Valley Cottage, N.Y.; Lucia V. Salas, North Bergen; Dian M. Najarian, Lodi, both of N.J.

[73] Assignee: Lever Brothers Company, Division of Conopco, Inc., New York, N.Y.

[21] Appl. No.: 49,486

[22] Filed: Apr. 19, 1993

[51] Int. Cl.[6] ..... D06M 11/00

[52] U.S. Cl. ..... 252/8.6; 252/8.8; 252/8.9

[58] Field of Search ..... 252/8.6, 8.8, 8.9

[56] References Cited

U.S. PATENT DOCUMENTS

| | | | |
|---|---|---|---|
| 4,724,089 | 2/1988 | Konig et al. | 252/8.8 |
| 4,999,121 | 3/1991 | De Block et al. | 252/8.8 |
| 5,114,600 | 5/1992 | Biggin et al. | 252/8.6 |
| 5,116,520 | 5/1992 | Lichtenwalter et al. | 252/8.6 |
| 5,133,885 | 7/1992 | Contor et al. | 252/8.6 |
| 5,180,508 | 1/1993 | Birkhan et al. | 252/8.8 |
| 5,232,612 | 8/1993 | Trinh et al. | 252/8.6 |

FOREIGN PATENT DOCUMENTS

| | | |
|---|---|---|
| 443313 | 8/1991 | European Pat. Off. . |
| 534009 | 3/1993 | European Pat. Off. . |
| 2173827 | 10/1986 | United Kingdom . |

*Primary Examiner*—Paul Lieberman
*Assistant Examiner*—Michael P. Tierney
*Attorney, Agent, or Firm*—A. Kate Huffman

[57] ABSTRACT

An aqueous concentrated fabric conditioning composition is prepared by adding the co-melted mixture of cationic and nonionic agents to an acid solution. The resulting compositions are stable, have a viscosity of less than 300 cps, a pH of less than 4.0 and an average particle size of from about 2 to about 8 microns.

7 Claims, No Drawings

CONCENTRATED FABRIC CONDITIONING COMPOSITIONS

FIELD OF THE INVENTION

This invention relates to concentrated fabric conditioning compositions containing a mixture of cationic and nonionic actives prepared by adding the active mixture dispersion to an acid solution.

BACKGROUND OF THE INVENTION

Concentrated aqueous fabric conditioning compositions are well known in the art. These compositions contain various types of cationic materials either alone or in combination with other fabric softening components (e.g. U.S. Pat. Nos. 3,681,241, Rudy et al.; 4,439,335, Burns et al.; and 4,772,404, Fox et al.).

The conventional method of preparing such dual active formulations is to combine the components and add an acid agent as a finishing step to adjust the pH of the formulas to the desired range (see in particular Fox et al., U.S. Pat. No. 772,404). In Burns, 4, 439,335, it is taught that the fabric softening compositions should have a pH of from about 5.5 to about 6.5 prepared by adding small amounts of pH adjusting agents at the end of the preparation process.

De Block et al., U.S. Pat. No. 4,999,121 describes a preparation process wherein a solution of an acid is added in two steps prior to the addition of the fabric conditioning active and after the addition of softener. The compositions predominantly contain a cyclic amine and require solubilizer compounds such as polyethylene glycol be added separately from the actives as well as mixing speed higher than state of the art processes involving conventional softening agents, and the absence of water soluble ionizable salts which he teaches "give a detrimental effect on product stability" in state of the art made compositions.

Concentrated fabric conditioners having more than about 23% of softening actives have proven almost impossible to prepare by conventional state of the art processes without encountering problems such as product gelling and instability.

The various solutions used in the art have not been entirely satisfactory for preparing such concentrates.

There is, thus, a need for concentrated compositions having more than 23% fabric conditioning active without requiring a high shearing step.

It is an object of the present invention to provide a process for making stable highly concentrated fabric conditioning compositions.

It is a further object of the present invention to simplify the process for obtaining such compositions by introducing the actives into an acidified bath.

It is a further object of the present invention to provide concentrated fabric softening compositions made according to the process of the invention.

SUMMARY OF THE INVENTION

The present invention relates to the preparation of fabric conditioning compositions comprising:

A. from about 2 to about 11% by weight of a first conditioner agent selected from the group consisting of

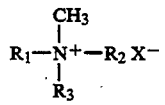

I wherein $R_1$ and $R_2$ can be the same or different from each other and are selected from the group consisting of C14 to C22 alkyl, alkenyl or ester-linked alkyl or alkenyl groups, and $R^3$ is selected from the group consisting of C1 to C4 alkyls, or $(C_nH_{2n}O)_xH$ wherein n is 2 or 3 and x is from 1 to about 3, and wherein X- is an anion, preferably a halide or alkyl sulfate having from 1 to 3 carbon atoms in the alkyl chain. Preferred compounds are those wherein $R_1$ and $R_2$ are hydrogenated tallow and $R_3$ is methyl). Examples of cationic surfactants within this invention are Adogen ® 442 (Witco Chemical Company), Arquad ® 2HT (Akzo Chemicals Inc.) and Kemamine ® Q-9702C (Witco Corporation); or

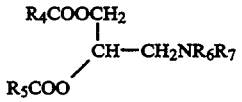

II wherein $R_4$ and $R_5$ are each an alkyl or alkenyl chain containing from 11 to 23 carbon atoms; and $R_6$ and $R_7$ are each an alkyl or hydroxy alkyl group containing from 1 to 4 carbon atoms or a benzyl group; In the preferred embodiments $R_6$ and $R_7$ are methyl groups. Such amine compounds are described in Naik, U.S. Pat. No. 4,137,180, herein incorporated by reference, B. from about 2 to about 28% by weight of a second cationic softener selected from the group consisting of

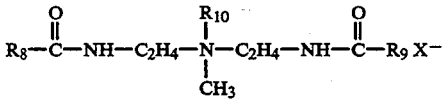

III wherein $R_8$ and $R_9$ are the same as each other or different and are selected from the group consisting C14 to C22 alkyl or alkenyl groups, and $R_{10}$ is selected from the group consisting of methyl or $(C_nH_{2n}O)_xH$ wherein n is 2 or 3 and x is from 1 to 5, and wherein X-is an anion, preferably selected from the group consisting of halides, sulfates, acetates or alkyl sulfates having from 1 to 3 carbon atoms in the alkyl chain, or compounds having Formula

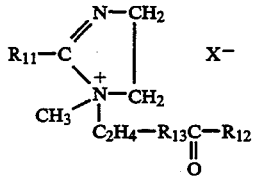

IV wherein $R_{11}$ and $R_{12}$ can be the same or different from each other and are selected from the group consisting of C 14 to C22 alkyl or alkenyl groups $R_{13}$ is NH or O, and wherein X-is an anion, preferably a halide or alkyl sulfates having from 1 to 3 carbon atoms in the alkyl chain, or imidazolinium salts having a formula

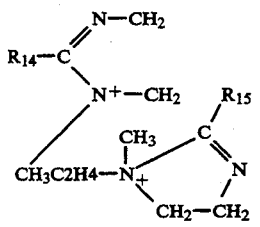

V wherein $R_{14}$ and $R_{15}$ are the same or different from each other and are selected from the group consisting of C 14 to C22 alkyl or alkenyl groups and wherein X- is an anion, preferably a halide or alkyl sulphate having from 1 to 3 carbon atoms in the alkyl chain; and C. from about 0.02 % to about 16% of a nonionic conditioning agent selected from the group consisting of Formula VI

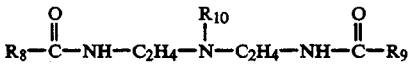

VI wherein $R_8$, $R_9$ and $R_{10}$ are as defined above, or an imidazoline selected from the group consisting of Formula

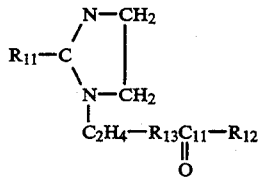

VII or

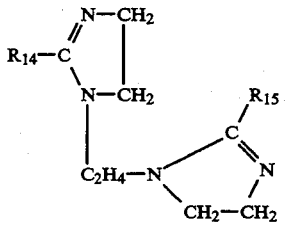

VIII wherein $R_{11}$, $R_{12}$, $R_{13}$, $R_{14}$ and $R_{15}$ are as defined above; and wherein the total amount of components A+B+C is from about 23% to about 35%, the final pH of the composition is 4.0, and an average particle size of the dispersions is about 2 to about 8 microns the process comprising the steps of (a) co-melting components A, B and C together at a temperature which is above the melting temperature of the highest melting component to form a homogeneous premix;

(b) adding an effective amount of an acid or an aqueous solution thereof to water at a temperature at or slightly below the temperature of the premix to obtain an acidic solution to obtain a final composition pH below 4.0;

(c) adding the premix to the acidic solution at a mixing speed between about 1 m/sec and 3 m/sec to form a homogeneous mixture;

(d) adding an effective amount of an inorganic salt or an aqueous solution thereof to the homogeneous mix to obtain a viscosity of the final composition between about 20 and about 300 centipoises using a Brookfield Spindle#1 at 12 rpm; and (e) optionally adding one or more additives selected from the group consisting of perfume, silicone emulsions, dyes, pigments, opacifiers, germicides, optical brighteners, any anti-corrosive agents and preservatives, the amount of each additive being up to 2.0% by weight of the composition.

Compositions prepared by the foregoing process containing the three Components A, B and C with at least 23% conditioning agent and having a pH of less than a 4.0 are also within the scope of the invention.

DETAILED DESCRIPTION OF THE INVENTION

The present invention pertains to concentrated aqueous fabric conditioner compositions having greater than 23% by weight of softener actives and having a pH of below 4.0. The compositions contain greater than 23% fabric conditioning agents selected from a combination of cationic softeners and nonionic conditioners. The viscosity of the compositions is in the range of from about 20 to 300 centipoises, preferably 20 to 200 centipoises.

The compositions of the invention do not exhibit the gelling problems encountered with many prior art concentrated compositions and exhibit good stability upon storage.

The fabric softening compositions of the invention contain the following components either as essential components or as optional ingredients: cationic surfactants for softening/antistatic benefits, nonionic conditioning agents, silicones for wrinkle reduction and enhancement of softness, viscosity control salts, fluorescents or bluing agents, dispersing agents, perfumes, and preservatives. Each of the components, both essential and optional, is discussed in greater detail as follows:

The prepared compositions contain

A. from about 2 to about 11% by weight of a first conditioner agent selected from the group consisting of

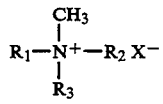

I wherein $R_1$ and $R_2$ can be the same or different from each other and are selected from the group consisting of C14 to C22 alkyl, alkenyl or ester-linked alkyl or alkenyl groups, and R6 is selected from the group consisting of C1 to C4 alkyls, or $(C_nH_{2n}O)_xH$ wherein n is 2 or 3 and x is from 1 to about 3, and wherein X- is an anion, preferably a halide or alkyl sulfate having from 1 to 3 carbon atoms in the alkyl chain. Preferred compounds are those wherein $R_1$ and $R_2$ are hydrogenated tallow and $R_3$ is methyl).

A preferred cationic surfactant of Component A within this invention is dihydrogenated tallow dimethyl ammonium chloride. Commercially available supplies of this compound are Adogen® 442 (Witco Chemical Company), Arquad® 2HT (Akzo Chemicals Inc.) and Kemamine® Q-9702C (Witco Corporation); or

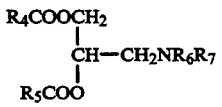

II wherein $R_4$ and R5 are each an alkyl or alkenyl chain containing from 11 to 23 carbon atoms; and $R_6$ and R7 are each an alkyl or hydroxy alkyl group containing from 1 to 4 carbon atoms or a benzyl group; In the preferred embodiments $R_9$ and $R_{10}$ are methyl groups.

Such amine compounds are disclosed in Naik, U.S. Pat. No. 4,137,180, herein incorporated by reference.

B. from about 2 to about 28% by weight of a second cationic softener selected from the group consisting of

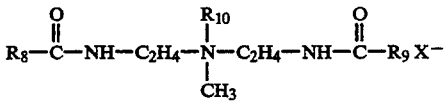

III wherein $R_8$ and $R_9$ are the same as each other or different and are selected from the group consisting C14 to C22 alkyl or alkenyl groups, and $R_{10}$ is selected from the group consisting of methyl or $(C_nH_{2n}O)_xH$ wherein n is 2 or 3 and x is from 1 to 5, and wherein X- is an anion, preferably selected from the group consisting of halides, sulfites, acetates or alkyl sulfates having from 1 to 3 carbon atoms in the alkyl chain. The preferred component B III is di(2-hydrogenated tallow/tallow amido ethyl) ethoxylated (2.5) methyl ammonium methyl sulfate or compounds having Formula

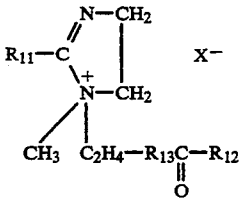

IV wherein $R_{11}$ and $R_{12}$ can be the same or different from each other preferably $R_{11}$ and $R_{12}$ are hydrogenated tallow/tallow and are selected from the group consisting of C14 to C22 alkyl or alkenyl groups, $R_{13}$ is—NH- or -O-, and wherein X- is an anion, preferably a halide or alkyl sulfates having from 1 to 3 carbon atoms in the alkyl chain, or imidazolinium salts having a formula

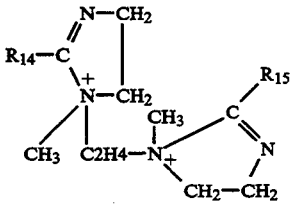

V wherein $R_{14}$ and $R_{15}$ are the same or different from each other and are selected from the group consisting of C14 to C22 alkyl or alkenyl groups and wherein X-is an anion, preferably a halide or alkyl sulphate having from 1 to 3 carbon atoms in the alkyl chain; and C. from about 0.02 % to about 16% of a nonionic conditioning agent selected from the group consisting of Formula VI

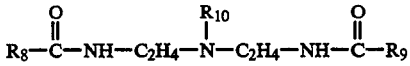

VI wherein $R_8$, $R_9$ and $R_{10}$ are as defined above, preferably $R_8$ and $R^9$ are hydrogenated tallow/tallow and $R^{10}$ is $(C_nH_{2n}O)_xH$ wherein n is 2 or 3 and x is from 1 to 5 or an imidazoline selected from the group consisting of Formula

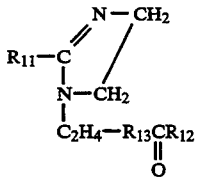

VII or

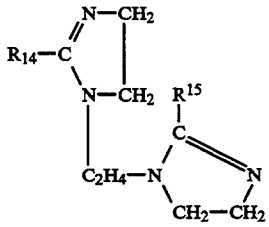

VIII wherein $R_{11}$, $R_{12}$, $R_{13}$, $R_{14}$ and $R_{15}$ are as defined above wherein the total amount of components A+B+C is from about 23% to about 35%, the total amount of conditioning active is at least 23% and the final pH of the composition is less than 4.0.

Commercially available supplies of the difatty alkyl amido ammonium salts of Formula III typically contain from about 13 wt. % to about 25 wt. % of residual amine in either the "free" or protonated form. Preferred compounds of Formula III are those wherein $R_{10}$ is $(C_2H_4O)_{2.5}H$. Examples of cationic surfactants within the invention of those sold under the series Accosoft 480 HC® and 590 HC® by Stepan Company of Northfield, Ill. The preferred compounds of the type B materials will contain substantially no inorganic salt such as sodium or potassium methosulfate or chloride.

Preferred compounds within component C include bis(alkylamidoethyl) 2-hdroxy ethyl amine and tallow amido ethyl -2-tallow imidazoline.

Preferred compositions of the invention are composed of a mixture of about 6 to about 8% by weight of dihydrogenated tallow dimethyl ammonium chloride (Formula I of Component A); from about 16 to about 20% by weight di(2-hydrogenated tallow/tallow amido ethyl) ethoxylated (2.5) methyl ammonium methosulfate (Formula III of Component B); and from about 2 to about 10 % by weight of di(2-hydrogenated tallow/tallow amido ethyl) ethoxylated (2.5) amine (Formula VI of Component C). In the most preferred embodiment up to about 2% by weight silicone is also present. The silicone may be co-melted with the actives or added at the end of the process as an emulsion.

Components A, B and C are co-melted in step (a) at a temperature above the melting point of the active having the highest melting point, to form a premixture. Various additives may also be included in the compositions. These include small amounts of incompatible and compatible silicones such as predominantly linear dialkylsiloxanes, e.g. polydimethylsiloxanes; polyalkyldimethylsiloxane, and polyalkyl amino dimethyl siloxane and mixtures thereof; quaternary ammonium salts having at least 1 C8-30 alkyl chain; soil release polymers such as block copolymers of polyethylene oxide and teriphthalates; fatty amines selected from the group consisting of primary fatty amines, secondary fatty amines, tertiary fatty amines and mixtures thereof; amphoteric surfactants; smectite type inorganic clays; anionic soaps; zwitterionic quaternary ammonium compounds; and nonionic surfactants.

In the preferred method, a component selected from this additive list is to be

Step (b) consists in preparing a solution of an acid in water at a temperature of from 50° to 100° C.

Bronstedt acids having a pKa value of 4 or less have been found suitable. Example include inorganic mineral acids, e.g., HCl, HBr, $H_2SO_4$. $HNO_3$ and $H_3PO_4$ and organic acids e.g., formic, citric, methylsulfonic and ethylsulfonic acid. Preferred acids are sulfuric acid formic acid, methylsulfonic acid and hydrochloric acid.

The selected acid should have a pKa value of not more than 4 and is added to the water in an amount of from about 0.2 to 0.6 mole equivalent to 1 mole of the amine compounds of Components A and C.

The acid is added to the water to obtain a final formulation pH of less than 4, preferably 2 to 4, most preferably 2 to 3. The entire quantity of acid is added into the water to obtain the desired pH. If the pH level is below 2, it may be adjusted at the end of the process to a level above pH 2. The inventive process requires the mixing of the premixture of fabric agents into the acid solution with agitation and at a temperature slightly below the temperature of the melting point of the premixture formed in step a, preferably, the heat source is turned off while mixing continues at a speed to create a vortex, but not at a high mixing speed. Preferably, the speed is set at about 1 to 3 m/seconds.

The selected speed range is preferable to obtain average particle diameter of the dispension of about 2 to about 8 microns. These relatively large particle sizes are preferred to obtain a stable product according to the inventive process. Particles having diameter sizes averaging less than 1 micron are deleterious to product stability.

A solution of inorganic salt is then added to the mixing composition in small aliquots, preferably a 10% salt solution is added in aliquots of less than 0.05% mls of the total amount of the composition. As the formulation thins, the speed is decreased further and the salt solution may be added in larger aliquots. The product is continuously mixed as it cools to a temperature slightly above a differential scanning calorimeter transition temperature, preferably about 90° F. to 130° F. During cooling, more electrolyte may be added to bring the viscosity of the formulation to a desired range as measured by a Brookfield Spindle#1 at 12 rpm.

Any other optional ingredients may be added to the mixture as it cools. Such optional ingredients include silicone emulsions, dyes, pigments, hydrocarbon oil emulsions, preservatives, optical brighteners or fluorescent agents, buffers, opacifiers, germicides and bactericides. The amount of each optional additive is up to about 2.0% by weight.

The invention will be further illustrated by the following non-limiting examples. Unless otherwise indicated, all percentages are expressed in terms of total actives of the compositions.

EXAMPLE 1

The following four formulations were prepared:

| Ingredients | A | B | C | D |
|---|---|---|---|---|
| Accosoft 480HC[1] | 24 | 22 | 20 | 20 |
| Adogen 442[2] | 6.5 | 6.5 | 6.5 | 6.5 |
| Sulfuric Acid | 0.06 | 0.06 | 0.06 | 0.04 |
| Calcium Chloride | 0.30 | 0.30 | 0.25 | 0.25 |
| Deionized Water | | to → | 100% | |

[1]Accosoft 480HC is supplied by Stepan Company of Northfield, Ill. and is Di(2-tallow/Hydrogenated Tallow Amidoethyl) ethoxylated methyl ammonium methosulfate.

[2]Adogen 442 is supplied by Witco Corp. and is dihydrogenated tallow dimethylammonium chloride.

The foregoing formulations were prepared by co-melting the Accosoft 480HC and Adogen 442 at a temperature of 160° F. The sulfuric acid was added to the deionized water at a temperature of about 160° F. to form an acid solution. The co-melted premixture was added with stirring at 1 m/seconds to form a homogeneous mixture at a temperature of 160° F. The mixing speed was increased to 3.5 m/seconds to create a vortex and solutions of calcium chloride were added in aliquots of about 0.05 mils to thin the mixing product. When the product cooled to a temperature of 120° F. calcium chloride was added to obtain initial viscosities of the four compositions between about 40 and 70 centipoise.

The iodine values of the actives, pH values, initial viscosities and viscosities after storage for one month at 35° F. were measured and tabulated in Table 1 as follows:

TABLE 1

| | A | B | C | D |
|---|---|---|---|---|
| Iodine Value | 4.9 | 4.8 | 4.7 | 4.7 |
| pH | 2.5 | 2.5 | 2.5 | 4.4 |
| Initial Viscosity (cps.) | 70 | 50 | 50 | 43 |
| Viscosity (1 month @ 35° F., cps.) | 195 | 100 | 53 | gel |

Formulations A, B and C contained a high active content (at least 26.5% by active weight and low iodine values (less than 4.9), that is the formulations were highly saturated. The pH values for the formulas A–C were all at 2.5. It was observed that at low temperature storage (35° F.) all three formulations exhibited good stability.

In comparison, formula D having a similar active content and low iodine value, exhibited a pH of 4.4, outside of the scope of the invention. Samples of formula D gelled when stored at low temperature (35° F.). Therefore, Formula D exhibited poor temperature stability in comparison to the formulations within the scope of the invention.

EXAMPLE 2

The following three compositions were prepared:

| Ingredients | E | F | G |
|---|---|---|---|
| Varisoft 110[3] | 20 | 20 | 20 |
| Adogen 442[4] | 6.5 | 6.5 | 6.5 |
| Sulfuric Acid | 0.1 | 0.1 | 0.1 |
| Calcium Chloride | .20 | .20 | .20 |

-continued

| Ingredients | E | F | G |
|---|---|---|---|
| Deionized Water | to 100 | to 100 | to 100% |

[3]Varisoft 110 is supplied by Witco Corp is di(2-hydrogenated tallow amidoethyl) ethoxylated methyl ammonium methosulfate.
[4]Adogen 442 is supplied by Witco Corp. and is dihydrogenated tallowdimethylammonium chloride.

Samples of Formulation E were prepared by co-melting the actives Varisoft 110 and Adogen 442 at a temperature of 180° F. to form a fabric conditioning premixture. Aliquots of 0.05 mils of calcium chloride were added to the mixture to thin the product to a viscosity of between 40 and 70 centipoise using a Brookfield Spindle#1 at 12 rpm. As a finishing step, the sulfuric acid was added to the mixture to obtain a pH of 2.0.

Samples of Formulation F were prepared as described for Formulation E, except that the solution of sulfuric acid was added to the fabric conditioning mixture after the addition of the premixture to the deionized water but before the addition of the electrolyte, A pH value of 2.0 was obtained.

Samples of Formulation G were prepared according to the invention.

The pH values, initial viscosities and iodine values of formulations E–G were obtained and tabulated as shown in Table 2 below:

TABLE 2

| | E | F | G |
|---|---|---|---|
| pH | 2.0 | 2.0 | 2.0 |
| Initial Viscosity (cps.) | gel | 415 | 120 |
| Iodine Value | ~0 | ~0 | ~0 |

It was observed that Formulations E and F prepared outside the scope of the process of the invention either gelled (Formulation E) or exhibited an undesirable viscosity (Formulation F). Formulation G prepared according to the invention exhibited a desirable viscosity of 120 cps.

EXAMPLE 3

The following four compositions were prepared according to Example 1:

| | H | I | J | K |
|---|---|---|---|---|
| Varisoft 110[3] | 12 | 12 | 12 | 12 |
| Varisoft 222[4] | 8 | 8 | 8 | 8 |
| Sodium methosulfate | high | high | −0 | −0 |
| Adogen 442[5] | 6.5 | 6.5 | 6.5 | 6.5 |
| Sulfuric acid | 0 | .05 | 0 | 0.05 |
| Calcium Chloride | 0.25 | 0.25 | 0.25 | 0.25 |
| Deionized Water | to 100% | to 100% | to 100% | to 100% |

[3]di(2-hydrogenated tallow amidoethyl)ethoxylated methyl ammonium methosulfate.
[4]di(2-tallowamidoethyl) ethoxylated methyl ammonium methosulfate.
[5]dihydrogenated tallow dimethyl ammonium chloride.

The iodine values, pH values, initial viscosities and viscosities after storage for 1 month at 35° F. were measured and tabulated in Table 3 as follows:

| | H | I | J | K |
|---|---|---|---|---|
| Iodine value | 15.2 | 15.2 | 15.2 | 15.2 |
| pH | 6.0 | 3.4 | 5.7 | 3.0 |
| Initial Viscosity (cps.) | gel | 400 | 45 | 100 |
| Viscosity (1 mo. @ 35° F. cps. | — | — | 33 | 75 |

Diamidoammonium raw materials containing a high level of inorganic salt such as sodium methosulfate are not highly concentratable. The preferred process improves the products formulability but best stabilities are found with products containing very low levels or no inorganic salt in the raw materials. The inorganic salt in the raw material is a by-product from the quaternization of the diamidoamine to the diamidoammonium. Higher levels are typically found in raw materials containing a higher quaternary active content. It is thus preferred to formulate with raw materials which contain a significant level of amine, 12% to 100%.

EXAMPLE 4

| | L | M |
|---|---|---|
| Accosoft 480 | 18 | 11 |
| Accosoft 480HC amine intermediate | 2.0 | 2.0 |
| Adogen 442 | 6.5 | 6.5 |
| Sulfuric acid | 0.05 | 0.3 |
| Calcium Chloride | 0.25 | 0.30 |
| Polydimethyl Siloxane | 0.60 | 0.60 |
| Deionized Water | to 100% | to 100% |

The pH values, initial viscosities and iodine values of Formulations L and M were obtained and tabulated as shown in Table 4 as follows:

TABLE 4

| | L | M |
|---|---|---|
| Iodine value | 4.7 | 4.7 |
| pH | 2.0 | 2.0 |
| Initial viscosity (cps.) | 50 | 43 |
| Viscosity (1 mo. @ 35° F., cps.) | 53 | 70 |

By using the preferred procedure, diamidoammoniums containing a high level of amines also exhibit satisfactory stabilities. The use of diamidoammoniums containing high levels of amines is advantageous because the amines are more efficient softeners, especially in combination with cationic softeners, than cationic softeners alone. This softness benefit is further enhanced by the presence of silicones.

We claim:

1. A process for the preparation of a concentrated aqueous composition containing A. from about 2 to about 11% by weight of a first conditioner agent selected from the group consisting of

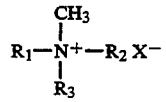

I wherein $R_1$ and $R_2$ can be the same or different from each other and are selected from the group consisting of $C_{14}$ to $C_{22}$ alkyl, alkenyl or ester-linked alkyl or alkenyl groups, and $R_3$ is selected from the group consisting of $C_1$ to $C_4$ alkyls, or $C_nH_{2n}O_xH$ wherein n is 2 or 3 and x is from 1 to about 3, and wherein $X^{31}$ is an anion selected from a group consisting essentially of a halide or alkyl sulfate having from 1 to 3 carbon atoms in the alkyl chain, or

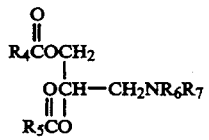

II wherein $R_4$ and $R_5$ are each an alkyl or alkenyl chain containing from 11 to 23 carbon atoms; and $R_6$ and $R_7$ are each an alkyl or hydroxy alkyl group containing from 1 to 4 carbon atoms;

B. from about 2 to about 28% by weight of a second cationic softener selected from the group consisting of

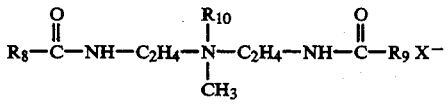

III wherein $R_8$ and $R_9$ are the same as each other or different and are selected from the group consisting of $C_{14}$ to $C_{22}$ alkyl or alkenyl groups, and $R_{10}$ is selected from the group consisting of $(C_nH_{2n}O)_xH$ wherein n is 2 or 3 and x is from 1 to about 3, and wherein $X^-$ is an anion, selected from a group consisting of halides, sulfates, acetates or alkyl sulfates having from 1 to 3 carbon atoms in the alkyl chain; and C. from about 0.02% to about 16% of a nonionic conditioning agent selected from the group consisting of a formula

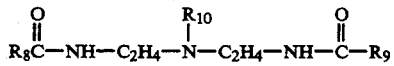

VI wherein $R_8$, $R_9$ and $R_{10}$ are as defined above, or an imidazoline selected from the group consisting of formula

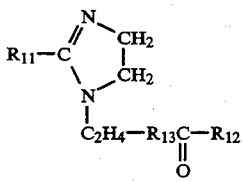

VII

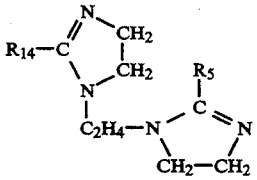

VIII wherein $R_{11}$, $R_{12}$, $R_{13}$, $R_{14}$ and $R_{15}$ are as defined above, wherein all three components A, B and C are free of an inorganic salt selected from the group consisting of sodium methosulfate, potassium methosulfate, sodium chloride, potassium chloride and mixtures thereof and the total amount of components A+B+C is from about 23% to about 35%, the final pH of the composition is less than 4.0, and an average particle size of the composition is about 2 to about 8 microns, the said process comprising the steps of:

(a) co-melting components A, B and C together at a temperature which is above the melting temperature of the highest melting component to form a homogeneous premix;

(b) adding an effective amount of a Bronstedt acid having a $pK_a$ equal to or less than 4.0 or an aqueous solution thereof to water at a temperature at or slightly below the temperature of the premix to obtain an acidic solution used to obtain a final composition pH below 4.0;

(c) adding the premix to the acidic solution at a mixing speed between about 1 m/sec and 3 m/sec to form a homogeneous mixture;

(d) adding an effective amount of an inorganic salt or an aqueous solution thereof to the homogeneous mix to obtain a viscosity of the final composition between about 20 and about 300 centipoises using a Brookfield Spindle#1 at 12 rpm; and (e) optionally adding one or more additives selected from the group consisting of perfume, silicone emulsions, dyes, pigments, opacifiers, germicides, optical brighteners, any anti-corrosive agents and preservatives, the amount of each additive being up to 2.0% by weight of the composition.

2. A process according to claim 1, wherein the total amount of Bronstedt acid in equivalent moles is in an amount from about 0.2 to about 0.6 per mole of amine compounds of component A and C.

3. A process according to claim 1 wherein the composition is comprised of Component A which is dihydrogenated (tallow/tallow dimethylammonium chloride, Component B which is di(2-hydrogenated tallow/-tallow amidoethyl)ethoxylated (2.5) methyl ammonium methosulfate and Component C is di(2-hydrogenated tallow/tallow amidoethyl)ethoxylated $_{(2.5)}$amine.

4. The process according to claim 1, wherein the Bronstedt acid is selected from the group of HCl, HBr, $H_2SO_4$, $H_2SO_3$ and $H_3PO_4$.

5. The process according to claim 1, wherein step a further comprises co-melting up to 2.0% of a silicone selected from the group consisting of a polydimethyl siloxane, an alkyl silicone and a alkylaminosilicone with the Components A, B and C.

6. A process according to claim 1, wherein up to 4% perfume is used in step e.

7. A process according to claim 1 wherein the Bronstedt acid of Step (b) is an organic acid selected from the group consisting of formic, citric, methylsulfonic and ethylsulfonic acid.

* * * * *

UNITED STATES PATENT AND TRADEMARK OFFICE

CERTIFICATE OF CORRECTION

PATENT NO. : 5,403,499

DATED : April 4, 1995

INVENTOR(S) : Jesse J. Kiefer, Lucia V. Salas, Dina M. Najarian

It is certified that error appears in the above-indentified patent and that said Letters Patent is hereby corrected as shown below:

On the title page, please change the inventor's name from "Dian" to —Dina—.

Signed and Sealed this

Twenty-sixth Day of September, 1995

*Attest:*

*Attesting Officer*

BRUCE LEHMAN

*Commissioner of Patents and Trademarks*